US005782366A

United States Patent [19]

Garza, Jr.

[11] Patent Number: 5,782,366

[45] Date of Patent: Jul. 21, 1998

[54] DISPLAY RACK FOR CASSETTE TAPES AND COMPACT DISCS

[76] Inventor: Fernando Garza, Jr., 3600 W. 26th St., Chicago, Ill. 60623

[21] Appl. No.: 759,056

[22] Filed: Dec. 2, 1996

[51] Int. Cl.[6] ..... A47G 19/08

[52] U.S. Cl. ..... 211/41.12; 211/169

[58] Field of Search ..... 211/94.5, 165, 211/169, 41.1, 41.12, 47, 96, 168; 312/901, 9.58, 9.55

[56] References Cited

U.S. PATENT DOCUMENTS

| | | | |
|---|---|---|---|
| 1,044,381 | 11/1912 | Harr | 211/169 |
| 3,960,273 | 6/1976 | Weston | 211/165 |
| 4,569,448 | 2/1986 | Graham . | |
| 5,226,548 | 7/1993 | Koeppel . | |
| 5,452,809 | 9/1995 | Capel . | |
| 5,551,577 | 9/1996 | Hagopian . | |

FOREIGN PATENT DOCUMENTS 24 32 715 4/1975 Germany .

*Primary Examiner*—Peter M. Cuomo
*Assistant Examiner*—Gerald A. Anderson
*Attorney, Agent, or Firm*—Michael I. Kroll

[57] ABSTRACT

A display rack (10) for cassette tapes (12) and compact discs (14) comprising a support structure (16). A plurality of holders (18) are provided. Each holder (18) is capable of receiving vertically a plurality of the cassette tapes (12) and/or compact discs (14). A facility (20) is for pivotally mounting the holders (18) vertically in side by side relationships to the support structure (16), so that the front and backs of the cassette tapes (12) and/or compact discs (14) can be viewed. An assembly (22) is for preventing unauthorized removal of the cassette tapes (12) and/or compact discs (14) from the holders (18).

15 Claims, 4 Drawing Sheets

30
44
20
38
10
42
46
52
42
40
22
54
42
42
18
16
38
46
28
30
14
30
48
56
24
44
38
46
42

DISPLAY RACK FOR CASSETTE TAPES AND COMPACT DISCS

BACKGROUND OF THE INVENTION

1. Field of the Invention

The instant invention relates generally to storage and organizing systems and more specifically it relates to a display rack for cassette tapes and compact discs.

2. Description of the Prior Art

Numerous storage and organizing systems have been in prior art. For example, U.S. Pat. Nos. 4,569,448 to Graham; 5,226,548 to Koeppel; 5,452,809 to Capel; 5,551,577 to Hagopian and German patent numbered 2432715 to Dyke all are illustrative of such prior art. While these units may be suitable for the particular purpose to which they address, they would not be as suitable for the purposes of the present invention as heretofore described.

An expandable storage system for securely storing materials of various shapes and sizes in an organized, easily identifiable and accessible manner. One or more rows of support members are removably secured upon a panel, so that their positions on the panel may be easily changed in order to secure materials of varying sizes and shapes. A resilient upper support member applies downward pressure on stored materials, so that they are held securely against the other support members in order to minimize movement. Additional panels may be quickly added to the system by snapping hinge members to the panel edge and connecting those hinge members, by gravity support, to higher members on an adjacent panel. Locations are provided for labels and other information relating to stored materials, with no separate space required for the label location. The storage system may be removably mounted on a structural surface during use and may be secured in a closed configuration similar to a suitcase for transporting.

A display rack for books, cassette tapes, compact disks, LP records, etc. comprises an I-frame support for at least two rotatable towers housed thereon. Two or more I-frames and towers are hinged together with the towers supported therebetween for rotation. With the I-frames connected together an extremely versatile structure is presented which enables the display to assume a wide variety of spatial configurations.

A rug rack includes a pair of similar frame structures supported in substantially parallel, spaced relation by an intermediate frame structure extending diagonally between and secured to both of the frame structures. The rug rack is free-standing, and does not need to be secured to any other supporting structure. A plurality of rug supporting members are pivotally secured to the intermediate frame structure for holding respective rugs in depending positions, each being freely pivotable into a viewing position. The pair of frame structures further includes outboard supports for holding a plurality of rolled rugs in axially upright positions. A canopy surrounds the upper portion of the rug rack, and has lights mounted interiorly thereof to illuminate rugs supported by the rug rack.

A merchandise display system includes a support structure. At least one display bar is mounted substantially vertically on the support structure and a plurality of merchandise holders or enclosures are disposed in a column along the display bar. Each enclosure includes an end portion having a bore for receiving the display bar. A display portion extends from the end portion and has a bottom panel, side walls and an open upper end. Each holder or enclosure further includes a retaining member configured to engage an adjacent enclosure in the column and permits alignment of the enclosures. The retaining member may be a peripheral flange extending around the bottom of the enclosure, permitting nesting of enclosures in the column. Each enclosure is pivotable about the display bar between a first position wherein the enclosure is aligned with at least one adjacent enclosure, thereby preventing removal of merchandise, and a second position wherein the enclosure is angularly displaced with respect to at least one adjacent enclosure, thereby permitting removal of merchandise. When the retaining member is a peripheral flange, an enclosure is vertically displaced along the display bar before being pivoted to its second position. A locking assembly may be provided to prevent displacement of enclosures along the display bar.

A shelf for displaying cassette boxes has wing(s), each with a rectangular frame which can be affixed at its vertical end sides. The frame is divided into superposed horizontal guides, in each of which slides an upward-open carrier. Each carrier receives a series of flat containers which lie free with their larger surface in the larger surface of the frame, and can be (partially) pulled out through the vertical side of the frame opposite the fastened end side, to permit insertion and removal of containers through the open upper side of the carrier. Each carrier can be arrested in its display position within the frame.

SUMMARY OF THE INVENTION

A primary object of the present invention is to provide a display rack for cassette tapes and compact discs, that will overcome the shortcomings of the prior art devices.

Another object is to provide a display rack for cassette tapes and compact discs, that is sturdy and allows the public to view fully the fronts and backs of the cassette tapes and compact discs.

An additional object is to provide a display rack for cassette tapes and compact discs, that will contain a built-in security to prevent theft and has the ability to display large quantities of cassette tapes and compact discs therefrom.

A further object is to provide a display rack for cassette tapes and compact discs that is simple and easy to use.

A still further object is to provide a display rack for cassette tapes and compact discs that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
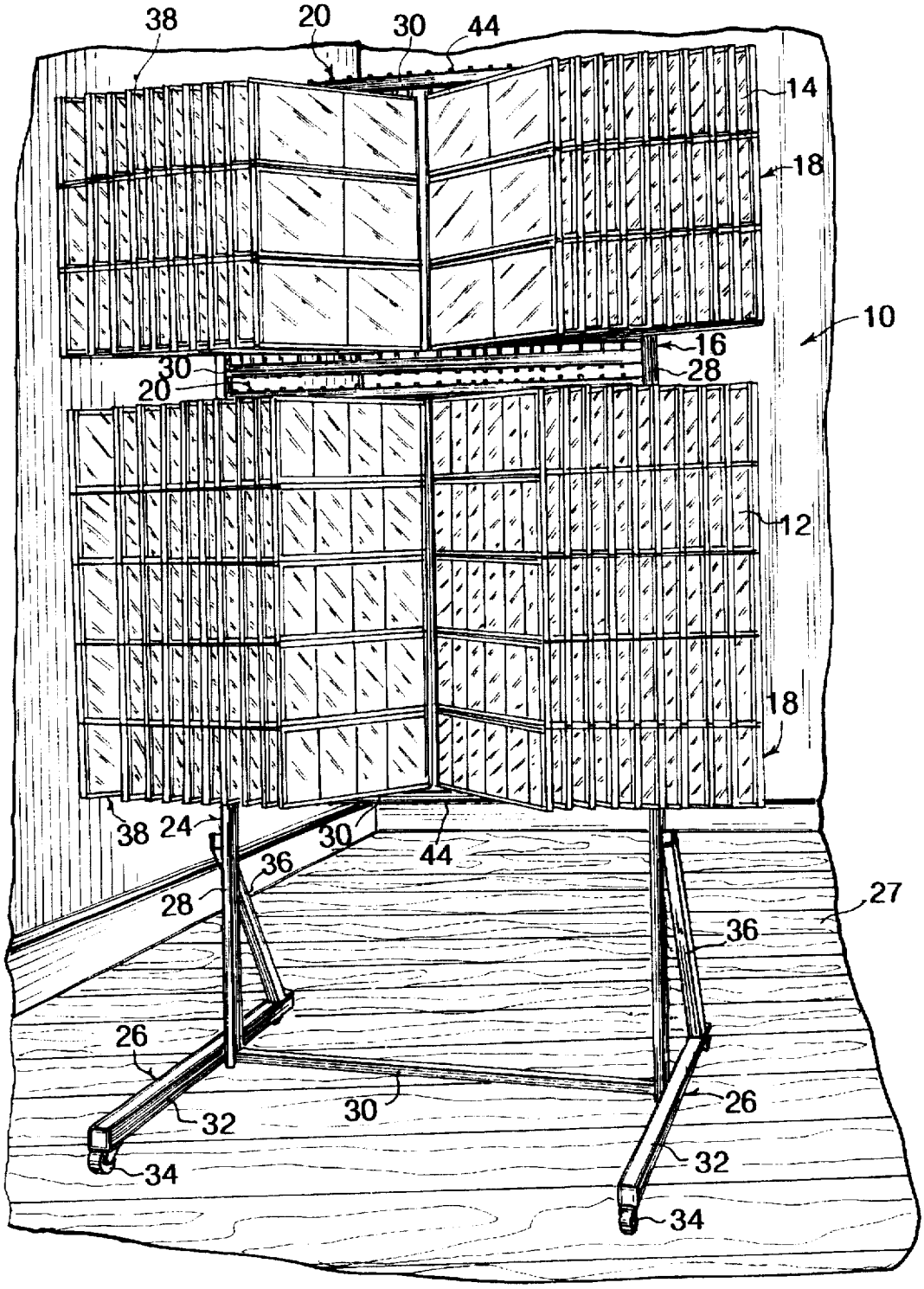
FIG. 1 is a front perspective view of a first embodiment of the instant invention.
Figure 2:
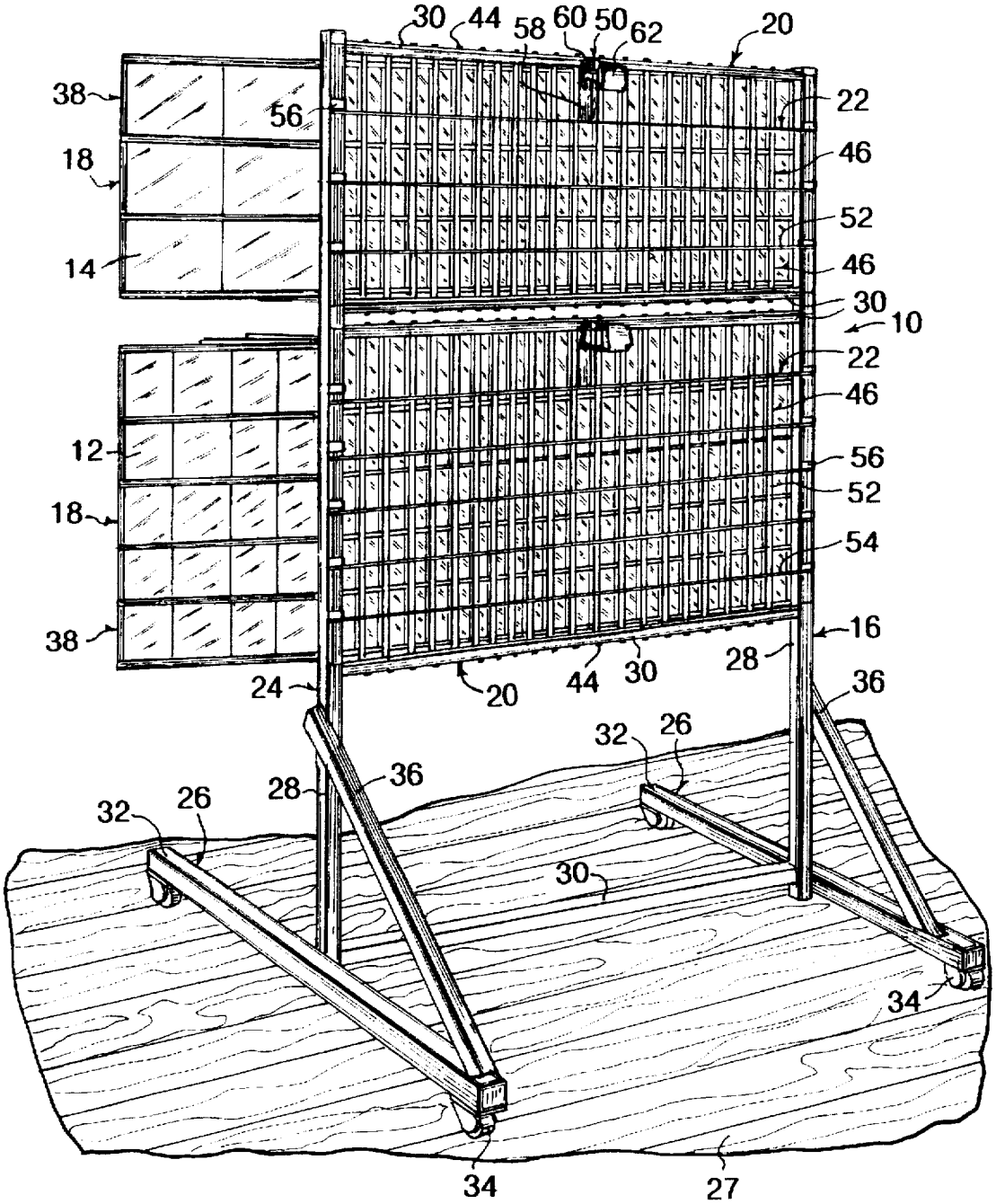
FIG. 2 is a rear perspective view of the first embodiment.

Turning now descriptively to the drawings, in which similar reference characters denote similar elements throughout the several views, FIGS. 1 to 4 illustrate a display rack 10 for cassette tapes 12 and compact discs 14, comprising a support structure 16. A plurality of holders 18 are provided. Each holder 18 is capable of receiving vertically a plurality of the cassette tapes 12 and/or compact discs 14. A facility 20 is for pivotally mounting the holders 18 vertically in side by side relationships to the support structure 16, so that the front and backs of the cassette tapes 12 and/or compact discs 14 can be viewed. An assembly 22 is for preventing unauthorized removal of the cassette tapes 12 and/or compact discs 14 from the holders 18.

The support structure 16 includes a rectangular framework 24 and components 26 for maintaining the rectangular framework 24 in an upright position on a floor 27. The rectangular framework 24 consists of a pair of spaced apart vertical side members 28. A plurality of spaced apart horizontal cross members 30 extend between and are attached at opposite ends to the vertical side members 28.

The maintaining components 26 are a pair of floor engaging horizontal extending base legs 32. Each base leg 32 includes a pair of casters 34, so that the support structure 16 can be moved easily upon the floor 27. Each base leg 32 further includes a brace member 36 extending diagonally up to the support structure 16, to better stabilize the support structure 16 in its upright position on the floor 27.

Each holder 18 consists of a plurality of rectangular frame members 38 affixed together in a column arrangement. Each frame member 38 has an open rear end 40 with top and bottom tracks 42 that will snugly receive vertically some of the cassette tapes 12 and/or compact discs 14.

Figure 3:
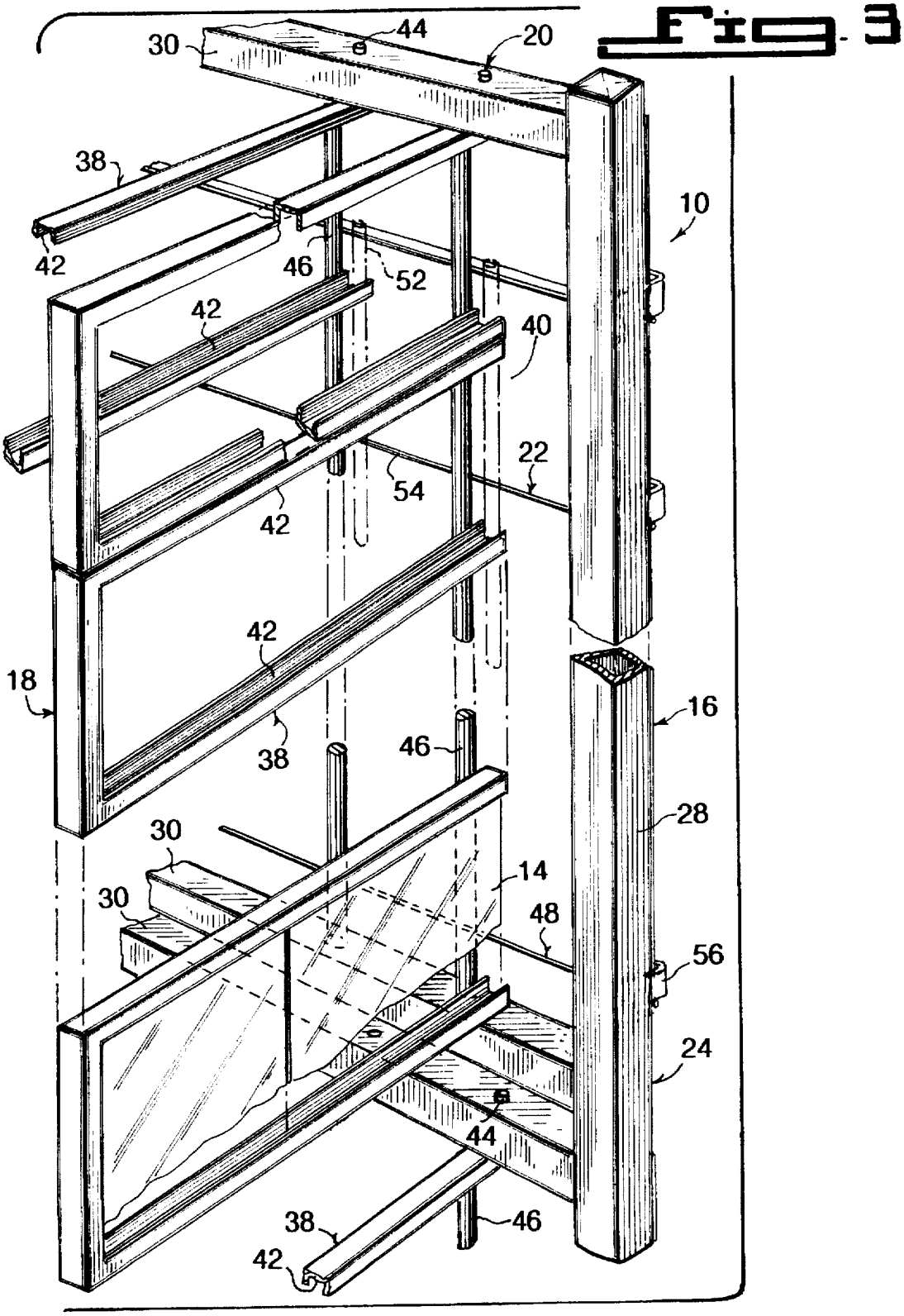
FIG. 3 is an enlarged front perspective view of a portion of the first embodiment, with parts broken away and in section.
Figure 4:
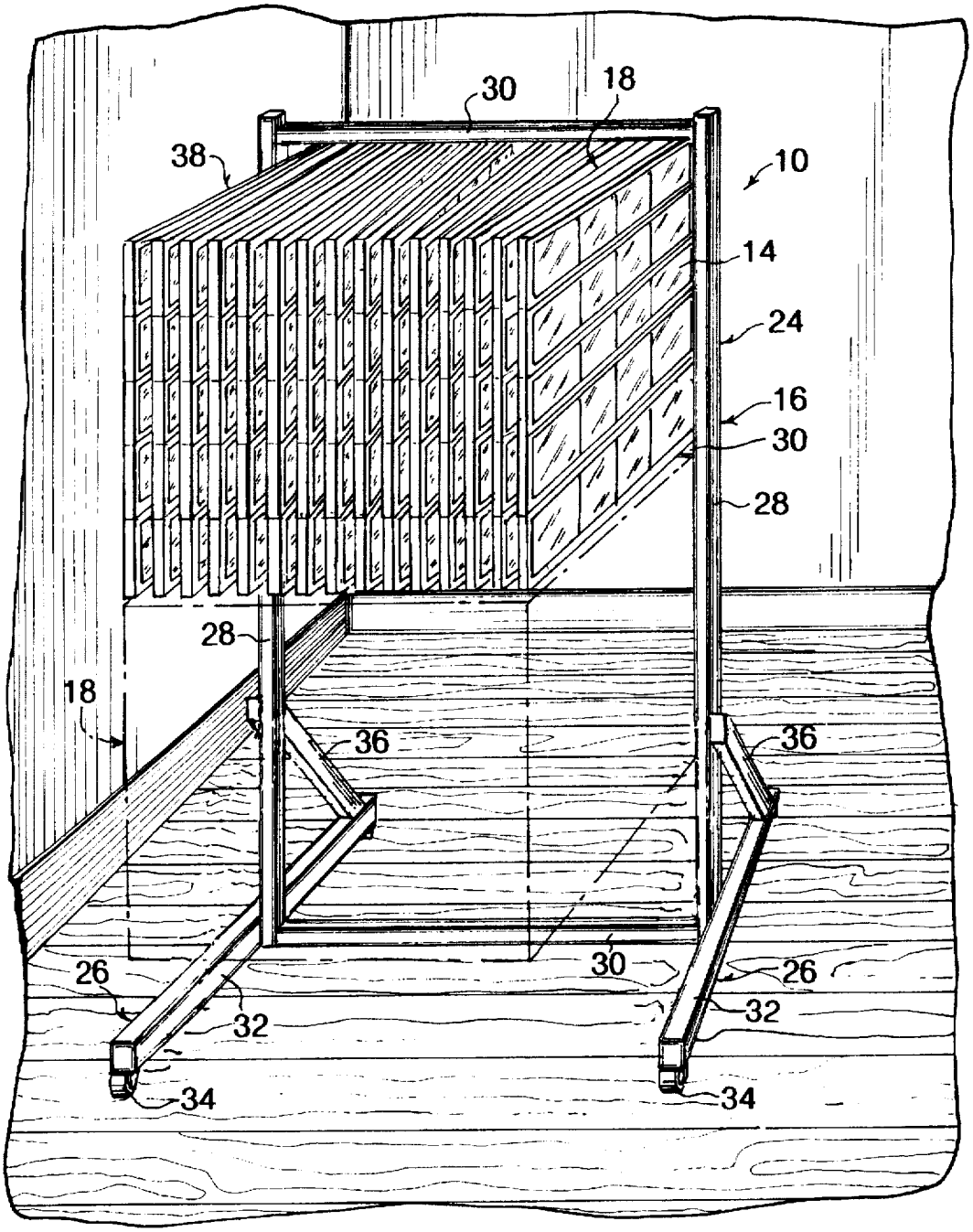
FIG. 4 is a front perspective view of a second embodiment of the instant invention, with parts shown in phantom.

The pivotally mounting facility 20 for each holder 18 includes a pair of pivot pins 44. Each pivot pin 44 extends vertically upwardly/downwardly from the rear of the holder 18, to fit into one of the horizontal cross members 30. A vertical stabilizer bar 46, as best seen in FIG. 3, is attached to one side of the frame members 38 adjacent the open rear ends 40.

The unauthorized removal preventing assembly 22 consists of a plurality of gates 48. An assemblage 50 is for attaching each gate 48 in a removable manner to a rear surface of the framework 24, so that the cassette tapes 12 and/or compact discs 14 will be maintained within the holders 18. Each gate 48 includes a plurality of vertical bars 46 and a plurality of horizontal bars 54 attached to the vertical bars 46, to form a grid between the vertical side members 28 and two of the horizontal cross members 30 of the rectangular framework 24.

Each attaching assemblage 50 comprises a plurality of vertically spaced apart brackets 56 mounted to the rear surfaces of the vertical side members 28, to engage with sides of one gate 48. A first strap fastener 58 is attached to the top horizontal bar 54 of the gate 48. A second strap fastener 60 is attached to the top horizontal cross member 30, so that a padlock 62 can engage with the first strap fastener 58 and the second strap fastener 60, to keep the gate 48 retained thereto.

OPERATION OF THE INVENTION

To use the display rack 10, the following steps should be taken:

1. Place the casters 34 of the base legs 32 upon the floor 27, so that the rectangular framework 24 is at a convenient location.
2. Make sure that all of the holders 18 are facing forward on the rectangular framework 24.
3. Unlock each padlock 62 from the respective first and second strap fasteners 58 and 60.
4. Remove the gates 48 from the rear of the rectangular framework 24.
5. Insert vertically all of the cassette tapes 14 and/or compact discs 14 through the open rear ends 40 and into the respective top and bottom tracks 48 in the frame members 38.
6. Replace the gates 48 onto the rear of the rectangular framework 24.
7. Lock each padlock 62 to the respective first and second strap fasteners 58 and 60, so that the fronts and backs of all of the cassette tapes 14 and/or compact discs 14 can be safely viewed therefrom.

LIST OF REFERENCE NUMBERS

10 display rack
12 cassette tape
14 compact disc
16 support structure of 10
18 holder for 12 and 14
20 pivotally mounting facility of 10
22 unauthorized removal preventing assembly of 10
24 rectangular framework of 16
26 maintaining component of 16
27 floor
28 vertical side member of 24
30 horizontal cross member of 24
32 base leg of 26
34 caster on 32
36 brace member of 32
38 frame member of 18
40 open rear end of 38
42 top and bottom track of 38
44 pivot pin of 20
46 vertical stabilizer bar of 18
48 gate of 22
50 attaching assemblage of 22
52 vertical bar of 48
54 horizontal bar of 48
56 bracket of 50 on 28
58 first strap fastener of 50 on 54
60 second strap fastener of 50 on 30
62 padlock It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A display rack for cassette tapes and compact discs comprising:

a) a support structure having a rectangular framework and means for maintaining said rectangular framework in an upright position on the floor, said rectangular framework having:

i) a pair of spaced apart vertical side members; and ii) a plurality of spaced apart horizontal cross members extending between and attached at opposite ends to said vertical side members;

b) a plurality of holders, each said holder capable of receiving vertically a plurality of the cassette tapes/compact discs;

c) means for pivotally mounting said holders vertically in side by side relationships to said support structure, so that the front and backs of the cassette tapes/compact discs can be viewed; and d) means for preventing unauthorized removal of the cassette tapes/compact discs from said holders, said unauthorized removal preventing means including a plurality of gates and means for attaching each said gate in a removable manner to a rear surface of said framework, so that the cassette tapes/compact discs will be maintained within said holder.

2. A display rack for cassette tapes and compact discs as recited in claim 1, wherein each said gate includes:

a) a plurality of vertical bars; and b) a plurality of horizontal bars attached to said vertical bars to form a grid between said vertical side members and two of said horizontal cross members of said rectangular framework.

3. A display rack for cassette tapes and compact discs as recited in claim 2, wherein each said attaching means includes:

a) a plurality of vertically spaced apart brackets mounted to the rear surfaces of said vertical side members, to engage with sides of one said gate;

b) a first strap fastener attached to said top horizontal bar of said gate; and c) a second strap fastener attached to said top horizontal cross members, so that a padlock can engage with said first strap fastener and said second strap fastener to keep said gate retained thereto.

4. A display rack for cassette tapes and compact discs as recited in claim 1, wherein said maintaining means includes a pair of floor engaging horizontal extending base legs.

5. A display rack for cassette tapes and compact discs as recited in claim 4, wherein each said base leg includes a pair of casters, so that said support structure can be moved easily upon the floor.

6. A display rack for cassette tapes and compact discs as recited in claim 4, wherein each said base leg further includes a brace member extending diagonally up to said support structure, to better stabilize said support structure in its upright position on the floor.

7. A display rack for cassette tapes and compact discs as recited in claim 1, wherein each said holder includes a plurality of rectangular frame members affixed together in a column arrangement, wherein each said frame member having an open rear end with top and bottom tracks will snugly receive vertically some of the cassette tapes/compact discs.

8. A display rack for cassette tapes and compact discs as recited in claim 7, wherein each said holder further includes a vertical stabilizer bar attached to one side of the frame members adjacent said open rear ends.

9. A display rack for cassette tapes and compact discs as recited in claim 1, wherein said pivotally mounting means for each said holder includes a pair of pivot pins, each said pivot pin extends vertically upwardly/downwardly from the rear of the said holder to fit into one of said horizontal cross members.

10. A display rack for cassette tapes and compact discs as recited in claim 1, wherein each said base leg further includes a brace member extending diagonally up to said support structure, to better stabilize said support structure in its upright position on the floor.

11. A display rack for cassette tapes and compact discs as recited in claim 10, wherein each said holder includes a plurality of rectangular frame members affixed together in a column arrangement, wherein each said frame member having an open rear end with top and bottom tracks will snugly receive vertically some of the cassette tapes/compact discs.

12. A display rack for cassette tapes and compact discs as recited in claim 11, wherein said pivotally mounting means for each said holder includes a pair of pivot pins, each said pivot pin extends vertically upwardly/downwardly from the rear of the said holder to fit into one of said horizontal cross members.

13. A display rack for cassette tapes and compact discs as recited in claim 12, wherein each said holder further includes a vertical stabilizer bar attached to one side of the frame members adjacent said open rear ends.

14. A display rack for cassette tapes and compact discs as recited in claim 13, wherein each said gate includes:

a) a plurality of vertical bars; and b) a plurality of horizontal bars attached to said vertical bars to form a grid between said vertical side members and two of said horizontal cross members of said rectangular framework.

15. A display rack for cassette tapes and compact discs as recited in claim 14, wherein each said attaching means includes:

a) a plurality of vertically spaced apart brackets mounted to the rear surfaces of said vertical side members, to engage with sides of one said gate;

b) a first strap fastener attached to said top horizontal bar of said gate; and c) a second strap fastener attached to said top horizontal cross members, so that a padlock can engage with said first strap fastener and said second strap fastener to keep said gate retained thereto.

* * * * *